US005588652A

United States Patent [19]

Lang

[11] Patent Number: 5,588,652

[45] Date of Patent: Dec. 31, 1996

[54] GOLF RANGE GAME

[76] Inventor: John Lang, P.O. Box 3426, Scenic Caves Road, R.R. #3, Collingwood, Ontario, Canada, L9Y 3Z2

[21] Appl. No.: 529,770

[22] Filed: Sep. 18, 1995

[51] Int. Cl.[6] ..... A63B 67/02; A63B 69/36

[52] U.S. Cl. ..... 473/168; 473/409; 473/173

[58] Field of Search ..... 273/176 AB, 176 A, 273/176, 35 B

[56] References Cited

U.S. PATENT DOCUMENTS

| | | | |
|---|---|---|---|
| 1,851,423 | 3/1932 | Ely | 273/176 A |
| 1,852,948 | 4/1932 | Warren et al. | 273/176 A |
| 2,248,053 | 7/1941 | Bales | 273/176 A |
| 2,490,961 | 12/1949 | Hendry | 273/176 A |
| 3,578,333 | 5/1971 | Elesh | 273/176 R |
| 3,897,947 | 8/1975 | Heffley, Jr. | 273/35 B |
| 4,928,973 | 5/1990 | Perry et al. | 273/176 A |
| 5,163,683 | 11/1992 | Oswald | 273/176 R |
| 5,419,561 | 5/1995 | Weber | 273/176 AB |

FOREIGN PATENT DOCUMENTS 406182011 7/1994 Japan .

*Primary Examiner*—George J. Marlo
*Attorney, Agent, or Firm*— Bereskin & Parr

[57] ABSTRACT

A method and a facility for playing a game with a golf club and golf balls, the facility comprising:

a site having a range area visibly divided into a plurality of contiguous target regions, each said target region being associated with a target identifier, and a tee area having a plurality of contiguous tees from which golf balls may be hit toward said range area;

scoring means located at said site for scoring a game, said scoring means setting out a sequence of said target identifiers so as to establish a corresponding sequence of designated target regions to which golf balls are to be hit from the tee with a golf club in order, and said scoring means providing means for recording a point score for each time a player hits a golf ball; and a scoring system associated with said scoring means for awarding a point score according to the observed resting position of the golf ball relative to the designated target region.

19 Claims, 3 Drawing Sheets

GOLF RANGE GAME

FIELD OF THE INVENTION

The present invention relates to the game of golf and in particular to a method and facility for playing a game at a golf range.

BACKGROUND OF THE INVENTION

Golf is becoming an increasingly popular sport around the world. It can often be difficult, however, for various reasons for players to find a golf course where they can play. Also, a conventional round of golf takes at least several hours to play which can be prohibitive for many players. For these reasons, many people attend golf practice ranges to practice their golf shots without playing an actual round of golf. Hitting golf shots at a practice range can become monotonous, however, and there is a desire to incorporate a game into the practice routine.

Various forms of games played at golf ranges are known. Examples of such games are taught in U.S. Pat. Nos. 1,851,423 (Ely) and 2,248,053 (Bales) and in Japanese Patent 06-182011 (Buruusu). In each of these games, players hit golf balls from a tee area to a range area. The range area is adapted in various ways to facilitate the playing of a game.

In the Ely patent, the range area is divided into spaced transverse rows which are marked to indicate distances from the tee area. A number of target greens are located at various distances and positions about the range area. The Ely patent teaches a game where a player hits a golf ball toward the farthest target green and observes where it lands. If the ball lands on the green, the player determines how far the ball is from the pin (with the aid of concentric circles marked on the green) and the player then moves to a putting green (located behind the tee area) to attempt to sink a putt from a distance equivalent to the observed distance. If the player's drive does not reach the farthest green, the player determines how far the ball is from the pin (with the aid of the rows of distance markings). The player then hits another ball towards a target green that is located at a distance from the tee that approximates the observed distance for the player's first shot. The player continues until the ball reaches a target green and then he putts out at the putting green as described above.

The Bales and Buruusu patents each teach modified range areas that are divided into a grid pattern made up of spaced rows and columns. The rows are positioned at clearly marked distances from the tee area. The columns intersect the rows and define three areas corresponding to a fairway, a rough area and an out-of-bounds area similar to an actual golf course. A player is given a scorechart containing conventional distance markings for each hole of an 18 hole course. The player then utilizes the distance markings and grid pattern of the range area to play a modified form of an actual golf game. For instance, for a par 4 hole of 375 yards, the player attempts to hit a drive as close to the full 375 yards as possible within the fairway. If the player observes the ball landing in the 200 yard grid of the fairway, he knows that his next shot should be for the 175 yard grid to equate to landing his ball on the green. If the player drives into the rough portion of the fairway, he is assessed a distance penalty, and if the player drives out of bounds, he is assessed a stroke penalty. Optional chipping areas and putting greens are also contemplated for completing the hole.

While the above-described games permit a modified form of golf to be played at a range area, they are relatively complicated to play. Also, the games do not provide an optimum means for scoring that allows for healthy competition between players. Moreover, the known games do not satisfactorily measure and reward a player's accuracy in driving and chipping or promote the development of the skills that yield accuracy. The known games also do not facilitate imitation of a variety of different courses, whose fairways may feature not only a variety of different overall distances, but also a variety of different layouts, hazards and obstacles that require the golfer to combine different combinations of long, short and medium drives to get from the tee to the green of each hole.

The object of the present invention is to provide an alternative golf range game that is simple to play and incorporates a straightforward scoring system so that players may compete against each other to increase their enjoyment, and that promotes development of the players' golfing skills to achieve accuracy in driving and chipping as well as distance.

SUMMARY OF THE INVENTION

According to one aspect, the present invention provides a method for playing a game at a golf range facility. The method comprises a number of steps. First, a designated target region is determined from scoring means that sets out a sequence of target identifiers, each of which is associated with one of a plurality of contiguous, visibly divided target regions in a range area of the facility. Second, a golf ball is hit with a golf club from a tee of the facility toward the designated target region as determined in the first step. Third, a point score is recorded by the scoring means, the score being awarded according to the observed resting position of the golf ball hit in the second step relative to said designated target region as determined in the first step. Then, these three steps are repeated until the sequence of target identifiers set out by the scoring means has been completed in order.

According to another aspect, the invention also provides a facility for playing a game with a golf club and golf balls. The facility comprises a site and a scoring means. The site has at least one tee, and also has a range area visibly divided into a plurality of contiguous target regions, each said target region being associated with a target identifier. The scoring means sets out a sequence of such target identifiers so as to establish a series of designated target regions to which golf balls are to be hit from the tee with a golf club in order, and provides means for recording a point score for each time a player hits a golf ball, the score being awarded according to the observed resting position of the golf ball relative to the designated target region.

Preferably, the target regions are arranged in a grid of intersecting rows and columns, with each target region being identified by a row identifier and a column identifier.

More preferably, the scoring means includes a chart with an arrangement of target identifiers for 18 holes of golf. The target identifiers are arranged in spaced relationship with blank writing areas adapted to record point scores.

Most preferably, a plurality of scorecharts are provided for a player to select. The scorecharts would set out different sequences of target identifiers corresponding to different golf courses.

It has been found that the golf game method and facility of the present invention is simpler to play than prior known games and provides for healthier competition among players and promotes development of playing skills.

BRIEF DESCRIPTION OF THE DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENT

Figure 1:
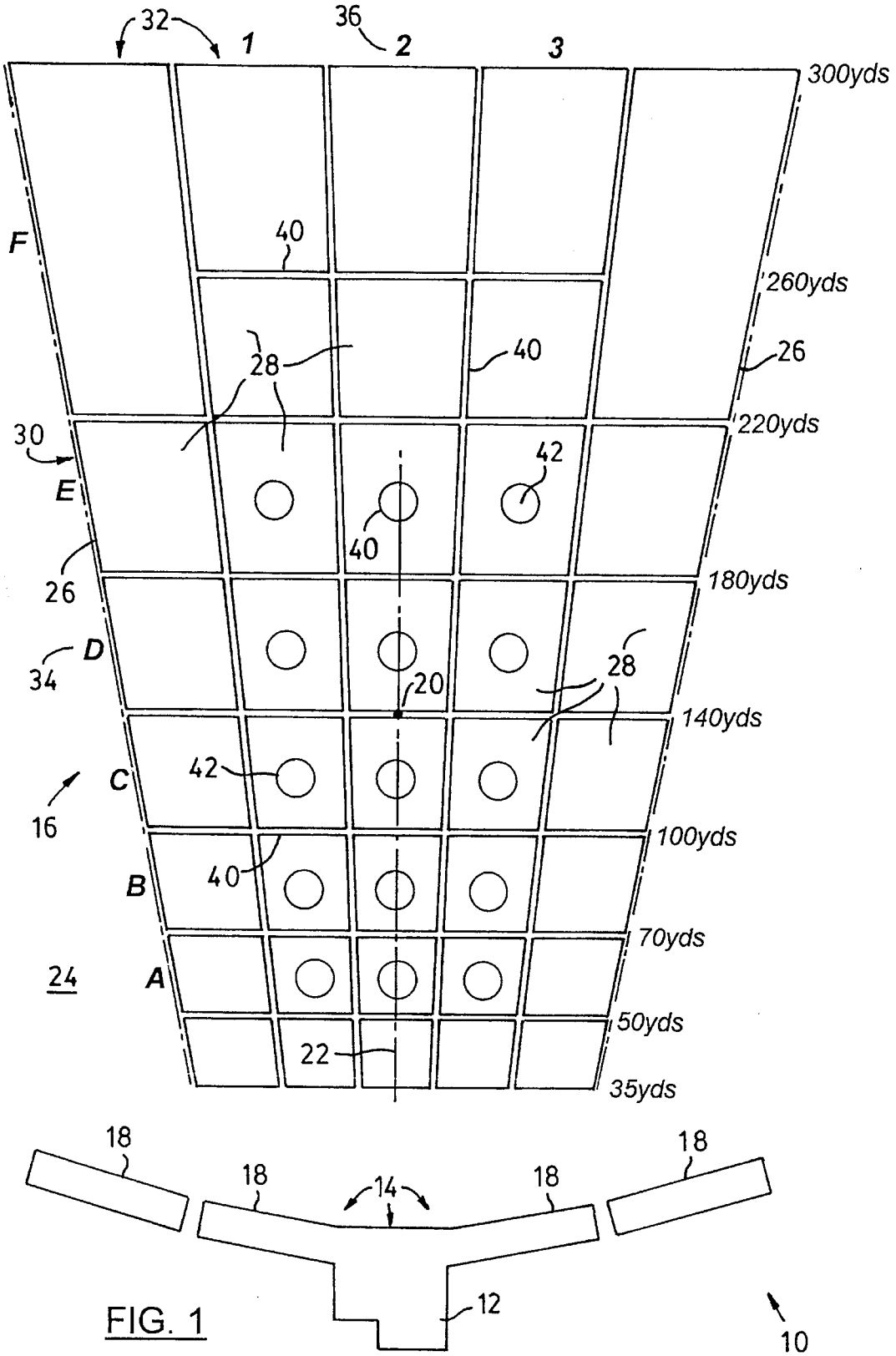
FIG. 1 is a plan view of a golf range facility in accordance with the present invention.

A golf facility in accordance with the present invention is shown generally at 10 in FIG. 1. The golf facility includes a club house 12, a tee area 14 and a range area 16.

Figure 2:
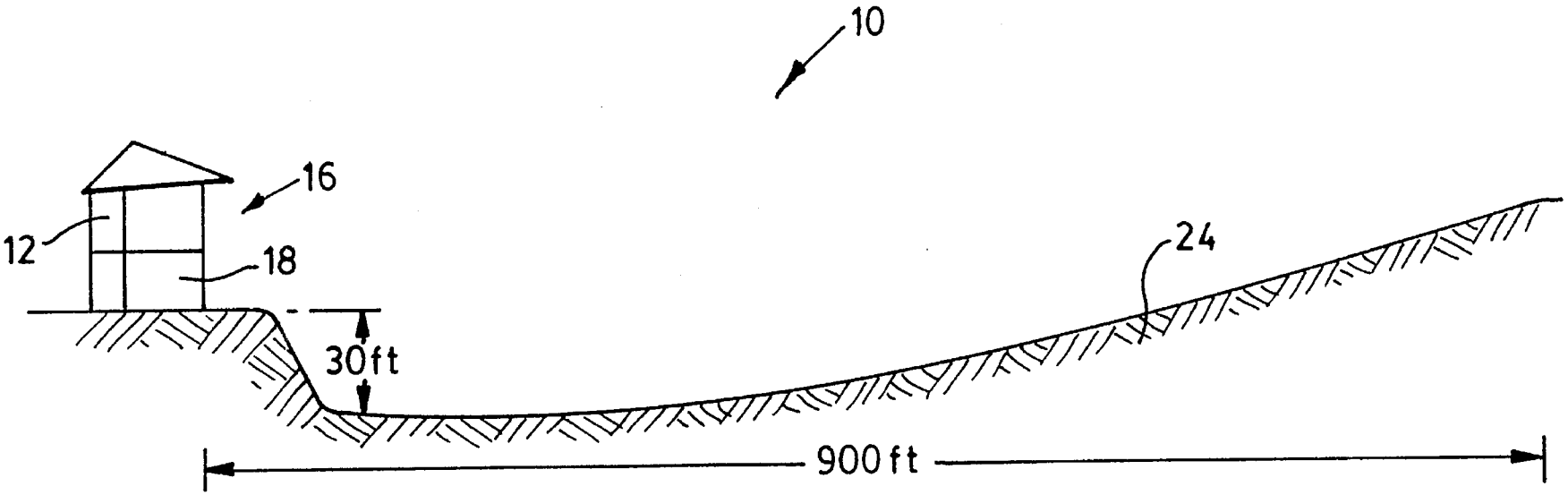
FIG. 2 is a sectional view of the golf range facility taken along lines 2—2 of FIG. 1.

Referring to FIGS. 1 and 2, the tee area 14 is divided into a series of tees 18 which are each sized to allow a player sufficient space to hit a golf ball towards the range area 16. Each tee is preferably also provided with seating and golf bag holders so that a group of players (preferably four players) can play a game from the same tee. The tees may be covered to protect players from the rain. Also, the tees may be stacked one above the other to allow more players to play at one time. The tees are arranged in a radius relative to a point 20 on an imaginary longitudinal centre line 22 of the range area 16. This arrangement of tee area 14 allows each tee to face generally toward the centre of the range area 16.

The range area 16 is formed over a substantially open area such as a field 24. In the preferred embodiment, it is contemplated that approximately ten acres of area is required to house the entire golf facility.

The range area 16 preferably includes diverging side boundaries 26 in plan view so that the widest portion of the range area 16 is located furthest from the tee area 14. Nets 27 may be positioned outside the side boundaries 26 to prevent golf balls from travelling beyond the grounds of the golf facility.

The range area 16 is divided into target regions 28 that are arranged in a grid of intersecting rows 30 and columns 32. Thus, a particular target region within the grid may be identified by a row marking 34 and a column marking 36. The row and column markings are displayed on signs (not shown) in the range area 16 that are visible from the tee area 14. The boundary lines 40 for the rows and columns are clearly marked on the grass so that they are visible from the tee area 14. For instance, the lines could be marked by paint, lime or lengths of tape or rope. To aid visibility, the range area 16 preferably is positioned northwards relative to the tee area 14 along a gradual upward slope. Also, the tee area 14 is preferably elevated relative to a substantial portion of the range area 16.

The rows and columns of the grid are arranged such that the target regions 28 increase in area the further they are located from the tee area 14. In this way, the increased difficulty in accurately driving a golf ball over increasingly long distances is taken into account. The gradual increase in area of the target regions 28 is accomplished by increasing the spacing between the boundary lines 40 of the rows and/or diverging the boundary lines 40 of the columns 32. In the preferred embodiment, the row boundaries would be set at 35, 50, 70, 100, 140, 180, 220, 260 and 300 yards from the tee area 14. Furthermore, the column boundaries are preferably spaced 18 yards apart along the 35 yard row boundary and 35 yards apart at the 300 yard row boundary. Thus, the range area 16 diverges from a width of 90 yards at the 35 yard boundary to 175 yards at the 300 yard boundary.

Referring to FIG. 1, it may be seen that centre zones 42 are arranged in many of the target regions 28. The centre zones are marked with boundary lines 40 so that they are visible from the tee area 14. In the preferred embodiment, the centre zones have a diameter of approximately twenty feet.

In the preferred embodiment, the range area 16 is divided into five columns 32. The centre zones are located in the inner three columns 32 beginning at the 50 yard row boundary and ending at the 220 row boundary. The target regions 28 located beyond the 220 row boundary do not require centre zones. As will be explained in more detail below, points are awarded according to where a player's ball rests relative to a designated target region.

Figure 3:
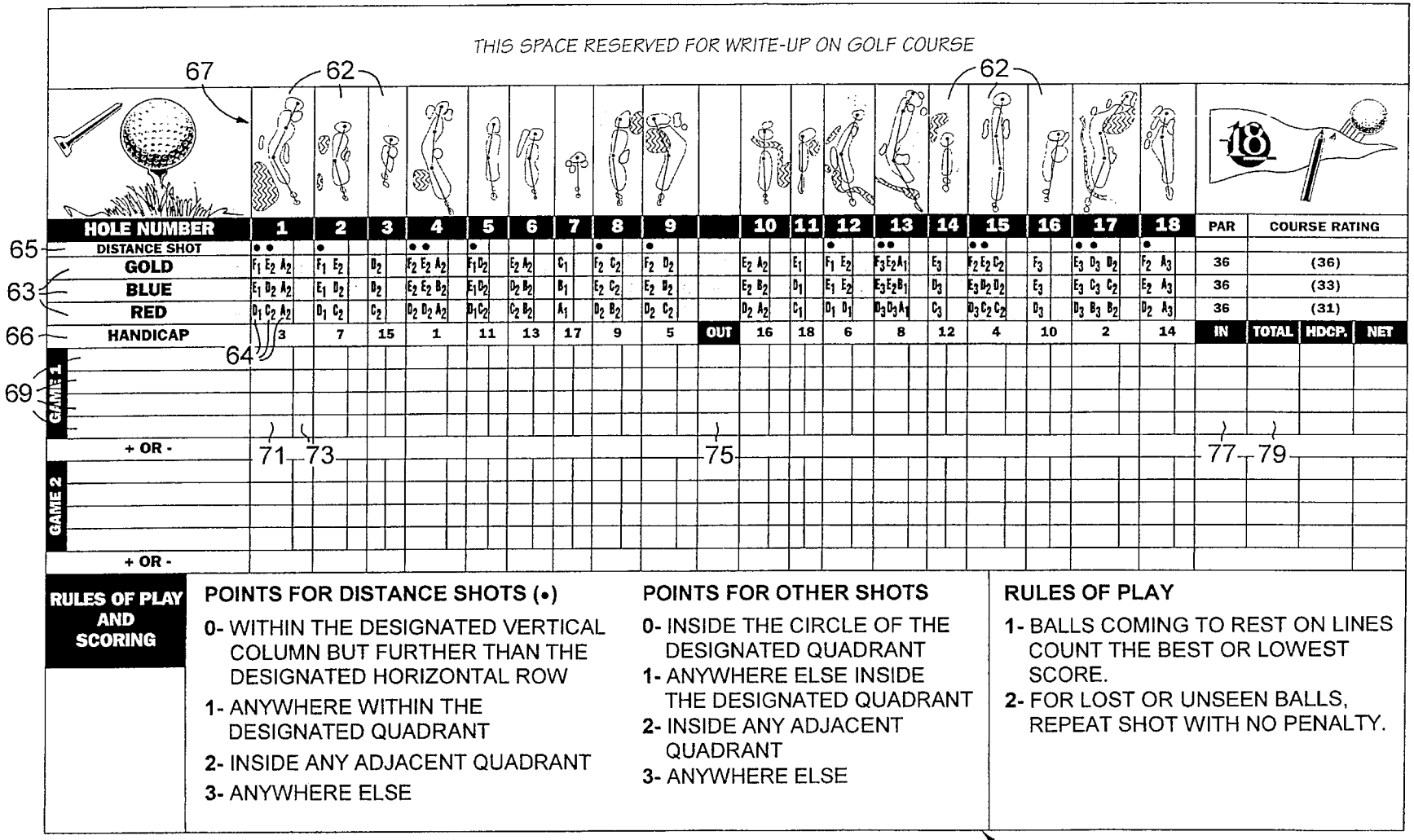
FIG. 3 is a plan view of a scorechart in accordance with the present invention.

Referring to FIG. 3, a scorechart 60 is depicted. The scorechart 60 includes eighteen scoring columns 62 corresponding to the eighteen holes of a conventional golf course. Several grid marking rows 63 intersect the scoring columns 62. Each of the scoring columns 62 have at least one grid marking 64 for identifying a particular target region in the range area 16. It will be noted that some scoring columns 62 include three grid markings along the row while other columns have one or two grid markings. This different arrangement of grid markings corresponds to the number of full shots required to reach a golf green in regulation for a particular par-rated hole. A par five hole would require three full shots, a par four hole would require two full shots and a par three hole would require one full shot. Accordingly, the front and back nine holes depicted on the game card each correspond to a conventional golf course arrangement of holes. For a conventional nine holes of par 36, the arrangement would consist of two par five holes, two par three holes and five par four holes. Of course, a different par course (e.g. par 71) would have a different arrangement of holes.

Several rows of grid markings are provided to account for players of different skill levels. In addition, the scorechart includes an information row 65 adjacent to each grid marking row for identifying whether the grid marking is scored as a distance shot (explained further below). Also, a handicap row 66 is provided for handicapping regular players of the game. A topography row 67 is provided so that the topography of each hole may be depicted in each scoring column. This is especially desirable when the scorechart is designed to mimic the shots made on an existing golf course which the player may be familiar with. The scorechart includes a multiplicity of score recording rows 69 for recording each player's score as the game is played. The score recording rows are divided by columns to define a shot score recording space 71 and a hole score recording space 73. A point score is inserted in the shot score recording space for each shot attempted for a particular hole. After a player has completed his or her shots for a particular hole, the individual shot scores are added up and the sum is placed into the hole score recording space. The scores from each of the hole score recording spaces are then summed up at the end of 9 and 18 holes and the sum totals are placed in the front nine recording space 75, back nine recording space 77 and game total recording space 79, as known in the art.

It is contemplated that the scorechart could be electronically displayed along with a computer animated depiction of the course. A player could then select a desired golf course and the computer would generate a scorechart directed specifically to the holes of the desired course. The number of players and their respective skill levels and handicaps could be entered upon the computer so that a customized game can be generated.

It will now be appreciated how the game is to be played. Before playing the game, the player chooses a scorechart and positions himself at a tee. The player then refers to the grid marking on the scorechart, selects an appropriate club and attempts to hit the golf ball into the target region identified by the grid marking. The player observes where his ball rests relative to the designated target region and then places a score in the scorechart according to a designated scoring system.

One preferred scoring system is as follows:

| Points | Result |
|---|---|
| 0 points | Ball rests in centre zone of designated target region |
| 1 point | Ball rests in designated target region |
| 2 points | Ball rests in adjacent target region |
| 3 points | Ball rests anywhere else |

Once the player has scored his shot, he refers to the scorechart to determine the next designated grid marking and repeats the above exercise. Once a player has attempted each of the one to three grid markings of a hole, the player adds the individual scores for each grid marking and the sum is awarded as the player's score for the hole. The player continues until all 18 holes are completed. Once all 18 holes are completed, the player with the fewest number of points would be declared the winner. Players who have played a specific game a number of times may average their scores to determine a handicap as known in conventional golf.

In a modified (and more preferred) version of the above scoring system, certain grid markings are scored as distance shots and certain grid markings are scored as target shots. The distance shot grid markings are those generally corresponding to longer distance shots on a golf course. These may vary according to a player's skill level. Accordingly, for a par five hole, the first two shots may be considered distance shots and for a par four hole, the first shot may be considered a distance shot. On certain courses, however, the first shot of a par five may require a layup. In such cases the first shot may instead be scored as a target shot. The designation of a distance shot is made in the distance shot information row 65. If no marking appears in the distance shot information row then the shot is a target shot.

A preferred scoring system for the modified version is as follows:

| Points | Result |
|---|---|
| Distance Shot | |
| 0 points | Balls rest in further row and same column as designated target region |
| 1 point | Ball rests in designated target region |
| 2 points | Ball rests in adjacent target region |
| 3 points | Ball rests anywhere else |
| Target Shot | |
| 0 points | Ball rests in centre zone of designated target region |
| 1 point | Ball rests in designated target region |
| 2 points | Bali rests in adjacent target region |
| 3 points | Ball rests anywhere else |

The game would be played in the same manner as described previously and the player with the fewest points at the end of 18 holes would be declared the winner.

It is to be understood that what has been described is a preferred embodiment of the invention. The invention is nonetheless susceptible to certain changes and alternative embodiments fully comprehended by the spirit of the invention as described above, and the scope of the claims set out below. For instance, the scale of the game may be adjusted to facilitate playing the game in one's backyard or over a small body of water (such as at a cottage). Also, a virtual simulation of the game could be developed for playing the game by computer with the player controlling a simulated golfer hitting golf balls.

I claim:

1. A facility for playing a game with a golf club and golf balls, the facility comprising:

a site having a range area visibly divided into a plurality of contiguous target regions, each said target region being associated with a target identifier, and a tee area having a plurality of contiguous tees from which golf balls may be hit toward said range area;

scoring means located at said site for scoring a game, said scoring means setting out a sequence of said target identifiers so as to establish a corresponding sequence of designated target regions to which golf balls are to be hit from the tee with a golf club in order, and said scoring means providing means for recording a point score for each time a player hits a golf ball; and a scoring system associated with said scoring means for awarding a point score according to the observed resting position of the golf ball relative to the designated target region.

2. A facility as claimed in claim 1, wherein said tee is elevated relative to said range area.

3. A facility as claimed in claim 1, wherein said range area is sloped upwardly in a direction away from said tee.

4. A facility as claimed in claim 1, wherein said range area has side boundaries that diverge as they extend away from said tee.

5. A facility as claimed in claim 1, wherein said range area is marked into at least three columns.

6. A facility as claimed in claim 1 further comprising a centre zone marked in at least one of said target regions.

7. A facility as claimed in claim 1, wherein said scoring means is provided by a pre-printed scorechart comprising:

a plurality of scoring columns; and at least one target identifier row intersecting said scoring column, at least one target identifier being marked along said target identifier row in each said scoring columns thereby designating a sequence of target regions so as to simulate similar golf shots that a player would make to reach a golf green in a conventional game of golf.

8. A facility as claimed in claim 7, wherein said scoring columns include one target identifier for a par 3 hole, two target identifiers for a par 4 hole and three target identifiers for a par 5 hole.

9. A facility as claimed in claim 7, further comprising a distance shot information row parallel to said target identifier row, said information row identifying whether said target identifier is scored as a distance shot.

10. A facility as claimed in claim 7, wherein nine scoring columns are provided and wherein two of said scoring columns include only one target identifier, two of said scoring columns include only three target identifiers, and five of said scoring columns include only two target identifiers.

11. A facility as claimed in claim 7, wherein eighteen scoring columns are provided and wherein four of said scoring columns include only one target identifier, four of said scoring columns include only three target identifiers and ten of said scoring columns include only two target identifiers.

12. A method for playing a game at a golf range facility comprising the steps of:

(a) determining a designated target region from scoring means that sets out a sequence of target identifiers, each of said target identifiers being associated with one of a plurality of contiguous, visibly divided target regions in a range area of the facility;

(b) hitting a golf ball with a golf club from one of a plurality of contiguous tees in a tee area of the facility toward said designated target region as determined in step (a);

(c) recording by said scoring means a point score awarded according to the observed resting position of the golf ball hit in step (b) relative to said designated target region as determined in step (a); and (d) repeating steps (a)–(c) until the sequence of target identifiers set out by said scoring means has been completed in order.

13. A method as claimed in claim 12, wherein said target regions are arranged in a grid of intersecting rows and columns, each of said target regions being identified by a grid marking having a row identifier and a column identifier.

14. A method as claimed in claim 12, wherein a centre zone is located in one or more of said target regions.

15. A method as claimed in claim 14, wherein, during said awarding points step, a player is awarded a different score according to whether said observed ball position is:

in the centre zone of the designated target region;

in the designated target region;

in a target region adjacent to the designated target region;

or elsewhere in the range area.

16. A method as claimed in claim 12, wherein, during said awarding points step, a player is awarded a different score according to whether his observed ball position is:

in the same column but a further row from the designated target region;

in the designated target region;

adjacent to the designated target region; or elsewhere in the range area.

17. A method as claimed in claim 12, wherein said scorechart uses a single grid marking to correspond to a par 3 hole.

18. A method as claimed in claim 12, wherein said scorechart uses two grid markings to correspond to a par 4 hole.

19. A method as claimed in claim 12, wherein said scorechart uses three grid markings to correspond to a par 5 hole.

* * * * *